US005515081A

United States Patent [19]

Vasilik

[11] Patent Number: 5,515,081

[45] Date of Patent: May 7, 1996

[54] SYSTEM AND METHODS FOR IMPROVED STORAGE AND PROCESSING OF BITMAP IMAGES

[75] Inventor: Kenneth E. Vasilik, Scotts Valley, Calif.

[73] Assignee: Borland International, Inc., Scotts Valley, Calif.

[21] Appl. No.: 160,529

[22] Filed: Nov. 30, 1993

[51] Int. Cl.[6] ..... G09G 1/02

[52] U.S. Cl. ..... 345/189; 345/192; 345/128; 345/141

[58] Field of Search ..... 345/189, 185, 345/190, 191, 187, 201, 141, 143, 128, 192; 395/164

[56] References Cited

U.S. PATENT DOCUMENTS

| | | | |
|---|---|---|---|
| 4,642,621 | 2/1987 | Nemoto et al. | 345/118 |
| 4,761,643 | 8/1988 | Fujiwara | 345/189 |
| 5,091,720 | 2/1992 | Wood | 345/185 |
| 5,245,323 | 9/1993 | Ichijo | 345/185 |
| 5,367,318 | 11/1994 | Beaudin et al. | 345/185 |

*Primary Examiner*—Richard Hjerpe
*Assistant Examiner*—Doon Chow
*Attorney, Agent, or Firm*—John A. Smart

[57] ABSTRACT

System and methods are described for storing and processing multiple bitmap images, such as those commonly employed in graphical user interfaces (GUIs), within a single "master" bitmap. Within a master bitmap, each image is bound by "corner brackets," each of which comprises a group of pixels which may be identified separately. Each image within a given master bitmap may be identified and processed as a separate image. Methods are described, for instance, for determining size, position, and identity of each image within a multi-image bitmap. Size is computed from the distance between the brackets surrounding an image; position may be computed relative to the position of the surrounding brackets. For identification, each image is provided with a unique ID or identifier, such as a number, embedded within the master bitmap itself. A method of the present invention for decoding an image from a master bitmap is also presented.

30 Claims, 18 Drawing Sheets

DECODE FUNCTION

```
void decode ( void )
{
```

501: INITIALIZE THE VALUE OF THE BACKGROUND PIXEL TO BE THAT OF THE ONE IN THE FAR UPPER LEFT HAND CORNER OF THE MASTER BITMAP.

```
background = get_pixel( 0, 0 );
```

503: X AND Y WILL SCAN THE MASTER BITMAP FROM LEFT TO RIGHT, TOP TO BOTTOM, STARTING AT THE PIXEL JUST TO THE RIGHT OF THE FAR UPPER LEFT CORNER (THE BACKGROUND PIXEL CANNOT BE USED FOR ANY OTHER PURPOSE).

```
int x = 1, y = 0;

for ( ; ; )
{
```

505: SEE IF THE CURRENT POSITION (DEFINED BY X AND Y) IS PART OF AN IMAGE WHICH HAS ALREADY BEEN DECODED. PIXEL_INSIDE_IMAGE RETURNS 0 IF NO SUCH IMAGE EXISTS, OTHERWISE IT RETURNS THE IMAGE OVERLAPPING THE PIXEL AT (X,Y).

```
Image * i = pixel_inside_image( x, y );
```

507: IF THERE WAS NO OVERLAPPING IMAGE, AND THE PIXEL AT THE CURRENT POSITION IS NOT THE SAME AS THE BACKGROUND PIXEL, THEN DECODE THE IMAGE AT THIS CURRENT POSITION.

```
if (!i && get_pixel( x, y ) != background)
     i = decode_image( x, y );
```

509: ADVANCE THE X COMPONENT OF THE CURRENT POSITION. IF THERE WAS EITHER AN IMAGE ALREADY AT THIS POSITION, OR WE JUST DECODED AN IMAGE HERE, THEN JUMP PAST THE IMAGE TO THE RIGHT. IF THERE WAS NO IMAGE THERE, THEN SIMPLY ADVANCE THE X COMPONENT TO THE RIGHT BY ONE PIXEL.

```
x += i ? i->w : 1;
```

FIG. 5A

511: IF THE CURRENT X POSITION IS OUTSIDE THE MASTER BITMAP, ADVANCE TO THE NEXT SCAN LINE AND RESET THE X COMPONENT TO BE AT THE FAR LEFT OF THE MASTER BITMAP.

```
        if (x >= master_bitmap_width)
        {
            x = 0;
            y++;
        }
```

513: IF THE Y COMPONENT OF THE CURRENT POSITION IS OUTSIDE THE MASTER BITMAP, THEN WE HAVE COMPLETELY SCANNED THE MASTER BITMAP AND SHOULD EXIT THE FOR LOOP.

```
        if (y >= master_bitmap_height)
            break;
    }
}
```

FIG. 5B

PIXEL_INSIDE_IMAGE FUNCTION

```
Image * pixel_inside_image ( int x, int y )
{
601:  ITERATE THROUGH ALL THE CURRENTLY DECODED IMAGES.
    for ( int j = 0 ; j < images.size() ; j++ )
    {
        Image & i =  images[j];
603:  IF THE POSITION, DEFINED BY THE ARGUMENTS SUPPLIED
      TO THIS FUNCTION, IS WITHIN THE CURRENT IMAGE, THEN
      RETURN THAT IMAGE.
        if (x >= i.x && x < i.x + i.w &&
            y >= i.y && y < i.y + i.h)
        {
            return & i;
        }
    }
605:  NO IMAGE WAS FOUND WHICH OVERLAPS THE GIVEN POSITION,
      RETURN A ZERO INDICATING SUCH.
    return 0;
}
```

*FIG. 6*

DECODE_IMAGE FUNCTION

```
Image * decode_image ( int x, int y )
{
```

701: THE LOCAL VARIABLE P GETS THE PIXEL VALUE OF THE UPPER LEFT CORNER OF THE UPPER LEFT BRACKET OF THIS IMAGE.

```
    Pixel p = get_pixel( x, y );
```

703: HERE WE DO A LITTLE ERROR CHECKING TO MAKE SURE THAT THE UPPER LEFT CORNER IS COMPLETE. THE ASSERT FUNCTION SIMPLY CHECKS ITS ONLY ARGUMENT TO MAKE SURE IT IS NOT NON-ZERO. IF IT IS, THEN A FAILURE IS TRIGGERED.

```
    assert( get_pixel( x + 1, y ) == p &&
            get_pixel( x, y + 1 ) == p );
```

705: REMEMBER THE LEFT EDGE IN THE VARIABLE LEFT_X.

```
    int left_x = x;
```

707: HERE WE SCAN ALONG THE TOP GUTTER OF THE IMAGE, LOOKING FOR THE LEFT EDGE OF EITHER AN UPPER RIGHT CORNER BRACKET OR THE UPPER TEE BRACKET (WHICH MUST BE THE SAME COLOR AS THE UPPER LEFT CORNER BRACKET).

```
    for ( x += 2 ; x < master_bitmap_width ; x++ )
        if (get_pixel( x, y ) == p)
            break;
```

709: HERE WE MAKE SURE WE DID NOT FALL OFF THE END OF THE MASTER BITMAP, AND WE DID INDEED FIND THE EDGE OF THE UPPER RIGHT CORNER BRACKET/TEE BRACKET.

```
    assert( x < master_bitmap_width &&
            get_pixel( x, y ) == p );
```

711: AGAIN, WE MAKE SURE THAT THE UPPER RIGHT CORNER BRACKET IS COMPLETE, AND THE OTHER TWO PIXELS COMPRISING IT ARE OF THE SAME COLOR.

```
    assert( get_pixel( x + 1, y ) == p &&
            get_pixel( x + 1, y + 1 ) == p );
```

713: NOW, WE CHECK TO SEE IF THERE IS A MASK ASSOCIATED WITH THIS IMAGE. THE HAS_MASK VARIABLE WILL, AFTER THIS WILL CONTAIN A BOOLEAN VALUE INDICATING THE EXISTENCE OF A MASK.

```
    int has_mask = 0;
```

FIG. 7A

715: BUMP THE X POSITION TO BE EITHER THE RIGHT EDGE OF THE UPPER RIGHT CORNER BRACKET, OR THE MIDDLE OF A POSSIBLE TEE BRACKET.

```
x++;
```

717: CHECK TO SEE IF THERE IS A FOURTH PIXEL COMPRISING A TEE BRACKET. ALSO MAKE SURE WE AREN'T TRYING TO LOOK AT PIXELS WHICH ARE NOT IN THE MASTER BITMAP.

```
if (x + 1 < master_bitmap_width &&
    get_pixel( x + 1, y ) == p)
{
```

719: SAVE AWAY THE CURRENT X POSITION, WHICH HAPPENS TO BE THE MIDDLE OF THE UPPER TEE BRACKET.

```
    int save_x = x;
```

721: HERE WE PUSH X PAST THE LAST FARTHEST RIGHT PIXEL IN THE UPPER TEE, AND SCAN FOR THE LEFT MOST PIXEL OF THE UPPER RIGHT BRACKET.

```
    for ( x += 2 ; x < master_bitmap_width ; x++ )
        if (get_pixel( x, y ) == p)
            break;
```

723: MAKE SURE WE DID NOT FALL OFF THE END OF THE MASTER BITMAP, AND HAVE INDEED, FOUND THE CORNER BRACKET.

```
    assert( x < master_bitmap_width &&
            get_pixel( x, y ) == p );
```

725: MAKE SURE THE UPPER RIGHT CORNER BRACKET IS COMPLETE.

```
    assert( get_pixel( x + 1, y ) == p &&
            get_pixel( x + 1, y + 1 ) == p );
```

727: PUSH THE X POSITION PAST THE END OF THE UPPER RIGHT CORNER.

```
    x++;
```

729: MAKE SURE THE IMAGE AND THE MASK HAVE THE SAME WIDTH.

```
    assert( save_x - left_x == x - save_x );
```

731: REMEMBER THAT WE HAVE A MASK.

```
    has_mask = 1;
}
```

733: COMPUTE AND REMEMBER THE WIDTH OF THE IMAGE AND MASK, INCLUDING THE BRACKETS.

```
int w = x - left_x + 1;
```

FIG. 7B

735: REMEMBER THE POSITION OF THE TOP EDGE OF THE UPPER CORNER BRACKETS.

```
int top_y = y;
```

737: HERE WE SCAN DOWN TO FIND THE LOWER RIGHT BRACKET, MAKING SURE WE DON'T FALL OFF THE END OF THE MASTER BITMAP.

```
for ( y += 2 ; y < master_bitmap_height ; y++ )
    if (get_pixel( x, y ) == p)
        break;
```

739: MAKE SURE THAT WE DID INDEED FIND THE LOWER RIGHT CORNER BRACKET. ALSO MAKE SURE THE BRACKET IS COMPLETE.

```
assert( y < master_bitmap_height &&
        get_pixel( x, y ) == p );

assert( get_pixel( x, y + 1 ) == p &&
        get_pixel( x - 1, y + 1 ) == p );
```

741: ADJUST THE Y POSITION SO THAT IT IS AT THE BOTTOM EDGE OF THE LOWER BRACKETS.

```
y++;
```

743: COMPUTE THE HEIGHT OF THE IMAGE, INCLUDING THE UPPER AND LOWER BRACKET GUTTERS.

```
int h = y - top_y + 1;
```

745: MAKE SURE THE LOWER LEFT BRACKET EXISTS AND IS COMPLETE.

```
assert(
    get_pixel( left_x,     top_y + h - 1 ) == p &&
    get_pixel( left_x,     top_y + h - 2 ) == p &&
    get_pixel( left_x + 1, top_y + h - 1 ) == p );
```

FIG. 7C

747: IF THERE IS A MASK ASSOCIATED WITH THIS IMAGE, MAKE SURE THAT THERE IS A MIDDLE TEE BRACKET BETWEEN THE IMAGE AND THE MASK.

```
if (has_mask)
{
    int xx = left_x + w / 2, yy = top_y + h;

    assert(
        get_pixel( xx - 1, yy - 1 ) == p &&
        get_pixel( xx,     yy - 1 ) == p &&
        get_pixel( xx + 1, yy - 1 ) == p &&
        get_pixel( xx,     yy - 2 ) == p    );
}
```

749: NOW, SCAN FOR A BINARY ENCODED ID IN THE UPPER LEFT GUTTER.

```
int id = 0;
```

751: ID_X WILL START AT THE FAR RIGHT EDGE OF THE GUTTER (TO THE LEFT OF ANY EXISTING TEE BRACKET), WHERE THE FIRST BINARY DIGIT WILL EXIST.

```
int id_x = left_x - 3 +
    (has_mask ? w / 2 + 1 : w);
```

753: POWER_TWO WILL START AT ONE AND BE DOUBLED THROUGH EACH DIGIT.

```
int power_two = 1;
```

755: SCAN ID_X TO THE LEFT, GOING NO FURTHER THAT THE UPPER LEFT CORNER BRACKET. ALSO LIMIT THE ID TO A REASONABLE VALUE (HERE, 512).

```
while ( id_x >= left_x + 2 && power < 512 )
{
```

757: IF THE CURRENT DIGIT PIXEL IS NOT THE BACKGROUND PIXEL, THEN IT REPRESENTS A 1 BINARY DIGIT. ADJUST THE ID AS NEEDED.

```
    if (get_pixel( id_x, top_y ) != background)
        id += power;

    id_x--;
    power *= 2;
}
```

FIG. 7D

759: CHECK TO SEE IF THERE ARE ANY DIMENSION LIMITING PIXELS IN BOTH THE LEFT ANT BOTTOM GUTTER. FIRST, SCAN THE LEFT GUTTER.

```
int real_h = h - 2;
```

761: SCAN DOWN THE LEFT GUTTER, SEARCHING FOR A HEIGHT DELIMITING PIXEL.

```
int yy = top_y + 2;
for ( ; yy < top_y + h - 2 ; yy++ )
{
    if (get_pixel( left_x, yy ) != background)
    {
        real_h = yy - top_y - 1;
        break;
    }
}
```

763: NOW, SCAN THE BOTTOM GUTTER FOR A WIDTH DELIMITING PIXEL. ONLY SCAN AS FAR AS LAST_X, WHICH IS THE LEFT EDGE OF THE FAR RIGHT BRACKET OR TEE BRACKET.

```
int real_w = has_mask ? w / 2 - 1 : w - 2;

int last_x = has_mask ? left_x + w / 2 - 1
                      : left_x + w - 2;
```

765: SCAN TO THE RIGHT, STARTING FROM THE RIGHT EDGE OF THE LEFT CORNER BRACKET.

```
for ( int xx = left_x + 2 ; xx < last_x ; xx++ )
{
    if (get_pixel( xx, top_y + h - 1) !=
            background)
    {
        real_w = xx - left_x - 1;
        break;
    }
}
```

FIG. 7E

767: ADD THE NEW IMAGE DATA TO THE ARRAY AND FILL IN THE NEW ENTRY.

```
    Image & i = images [ images.size() ];

    i.id = id;
    i.x = left_x;
    i.y = top_y;
    i.w = w;
    i.h = h;
    i.real_w = real_w;
    i.real_h = real_h;
    i.has_mask = has_mask;

    return & i;
}
```

FIG. 7F

SYSTEM AND METHODS FOR IMPROVED STORAGE AND PROCESSING OF BITMAP IMAGES

COPYRIGHT NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

The present invention relates generally to image management in a computer system and, more particularly, to techniques for efficiently managing and processing bitmap information stored in such systems.

With the advent of the personal computer, the use of computer systems is becoming increasingly prevalent in everyday life. In the past, computers were often housed in highly restricted areas, with access limited to a few computer scientists and programmers. Today, however, computers can be seen on the desktops of most business professionals. Running software applications such as word processors and spreadsheets, for example, even the average business professional can realize substantial productivity gains. Besides the business environment, computers can also be found in wide use both at home and at school.

With increasingly widespread availability of powerful microprocessors, graphical user interfaces (GUIs, pronounced "gooeys") have become feasible. A GUI is a type of display format that enables a user to operate a computer by pointing to pictorial representations, such as "icons" (bitmaps) and "pull down" menus, displayed on a screen device. Choices are generally selected by the user with a keyboard and/or pointing device; the latter including such well-known devices as a mouse, track ball, digitizing tablet, light pen, or the like. Thus, the need for the user to memorize special commands has been lessened by the ability to operate a computer by selecting screen objects.

Well-known GUIs include Apple's Macintosh (Mac) interface, Microsoft's Windows, IBM's OS/2 Presentation Manager, Sun Microsystem's Open Look, and Open Software Foundation's Motif. Employing one or more windows, a menu bar, and a screen pointer, each of these systems can be readily distinguished from almost any non-GUI system. The screen cursor or pointer, typically displayed as a small arrow icon (bitmap), allows the user to select individual points on the screen. In operation, the screen cursor moves to a desired screen location in response to movements of a pointing device (e.g., mouse) by the user. Besides movement, most pointing devices include one or more switches or "mouse buttons" for specifying additional user input or "user events." For example, a user may select a screen point by "clicking" (depressing and releasing) a mouse button once while the cursor is positioned at the desired point. By double-clicking (two mouse clicks in rapid succession) a user may select an item and start an action. By "dragging" (continually depressing a mouse button) the user may move objects on the screen or select groups of objects. Thus, objects can be picked up, moved, and directly manipulated with a versatility that is not possible with a keyboard alone. Moveover, pointing is a very natural, human action which, unlike a keyboard, does not require any special training to master.

Software user interfaces rely heavily on bitmaps for rendering screen elements, such as buttons, icons, glyphs, and the like. Consider a typical user interface, as FIG. 1 depicts. Shown is a window interface 100 which includes a multitude of additional screen elements, each of which is rendered by a bitmap. For instance, task, minimize, and maximize screen buttons 101, 102, 103 are each derived from a particular bitmap. Notice the row of bitmap buttons or "toolbar" 110; again, each glyph of the button is the runtime appearance of a predefined bitmap. The window 100 may include additional windows, such as "Confirmation" dialog box; each "child" window may include in turn additional interior glyphs, such as buttons 120. All told, today's user interfaces depend, to a large extent, on bitmaps for their appearance. Thus, an important task in the design and construction of modern-day software programs is the management and processing of bitmaps.

By way of review, it is helpful to understand conventional methods by which bitmaps are employed in software development. Bitmaps and other "resources" (e.g., icon, menu, dialog, string, and the like) are typically stored in a special part of the program or executable file called the resource section. This is typically done during the "link" phase of program creation, when the object modules (i.e., source code which has been compiled into "object code") defining the program are combined or linked with other object modules, libraries, and resource files for creating the final binary image which defines the program. Each resource file used in the link is typically a binary file created by compiling one or more files which define bitmaps, icons, menus, dialogs, strings, and the like.

The general topic of resources is well covered by the technical, trade, and patent literature. For a detailed introduction to resources, including bitmaps, the reader may consult Petzold, C., Programming Windows, Second Ed., Microsoft Press, 1990. Additional treatment of the topic may be found in Petzold, C., Programming the OS/2 Presentation Manager, Section Four: Using Resources, Microsoft Press, 1989. The descriptions of the foregoing are hereby incorporated by reference. Development systems for compiling files into binary resources files (for binding to executables) are available from a variety of software development vendors, including Borland International of Scotts Valley, Calif., Microsoft Corp. of Redmond, Wash., and Symantec Corp. of Cupertino, Calif.

Of particular interest to the present invention are the problems attendant with storage and management of these bitmap resources. Conventionally, each resource bitmap file contains but a single image. Consequently, even the most modest of applications can accumulate a large number of bitmaps. The simple interface shown in FIG. 1, for instance, requires no fewer than fifteen bitmaps. Commercial programs of today, being far more complex than the interface of FIG. 1, require management of dozens or even hundreds of bitmap files. Bitmap management for these programs becomes an arduous task.

System and methods are needed for managing multiple bitmap images in a single bitmap resource, thereby reducing the number of bitmap files and easing the manipulation of these resources. The present invention fulfills these and other needs.

SUMMARY OF THE INVENTION

According to the present invention, multiple bitmap images, such as those commonly employed in graphical user interfaces (GUIs), are encoded into a single "master" bitmap. Within a master bitmap, each image is bound by "corner brackets." Each corner bracket in turn comprises a group of pixels which may be identified separately. Corner bracket pixels typically will assume a value (color) which differs from that of a reference pixel—one selected to specify a background color for the master bitmap. In this manner, the bracket pixels may be distinguished because their color is different from that of the background.

Employing system and methods of the present invention, each image within a given master bitmap may be identified and processed as a separate image. Steps are described, for instance, for determining size, position, and identity of each image within a multi-image bitmap. Size is computed from the distance between the brackets surrounding an image. Position may be computed relative to the position of the surrounding brackets. For identification, each image is provided with a unique ID or identifier, such as a number, embedded within the master bitmap itself. This identification scheme allows each image to be referenced via its ID. Moreover, the identity of an image within a multi-image bitmap is independent of that image's position.

Methods are described for decoding a desired image from a master bitmap. Generally, a decode method or function of the present invention operates by scanning a master bitmap (e.g., from left to right, top to bottom) looking for a pixel which is not the background color, and skipping over regions already occupied by existing images. Once such a pixel is found, the image may be decoded.

By encoding the size, position, mask (if any), and ID into the actual bitmap itself, the present invention provides a flexible system for storing and processing multiple images, all within a single bitmap. The approach has several advantages including saving storage space, decreasing memory allocation overhead, and saving time (i.e., faster system response).

BRIEF DESCRIPTION OF THE DRAWINGS

FIGS. 5–7 are commented source listings/flow diagrams which illustrate preferred methods of the present invention for decoding images stored in a single bitmap.

DETAILED DESCRIPTION OF A PREFERRED EMBODIMENT

General Architecture

A. System Hardware

Figure 1:
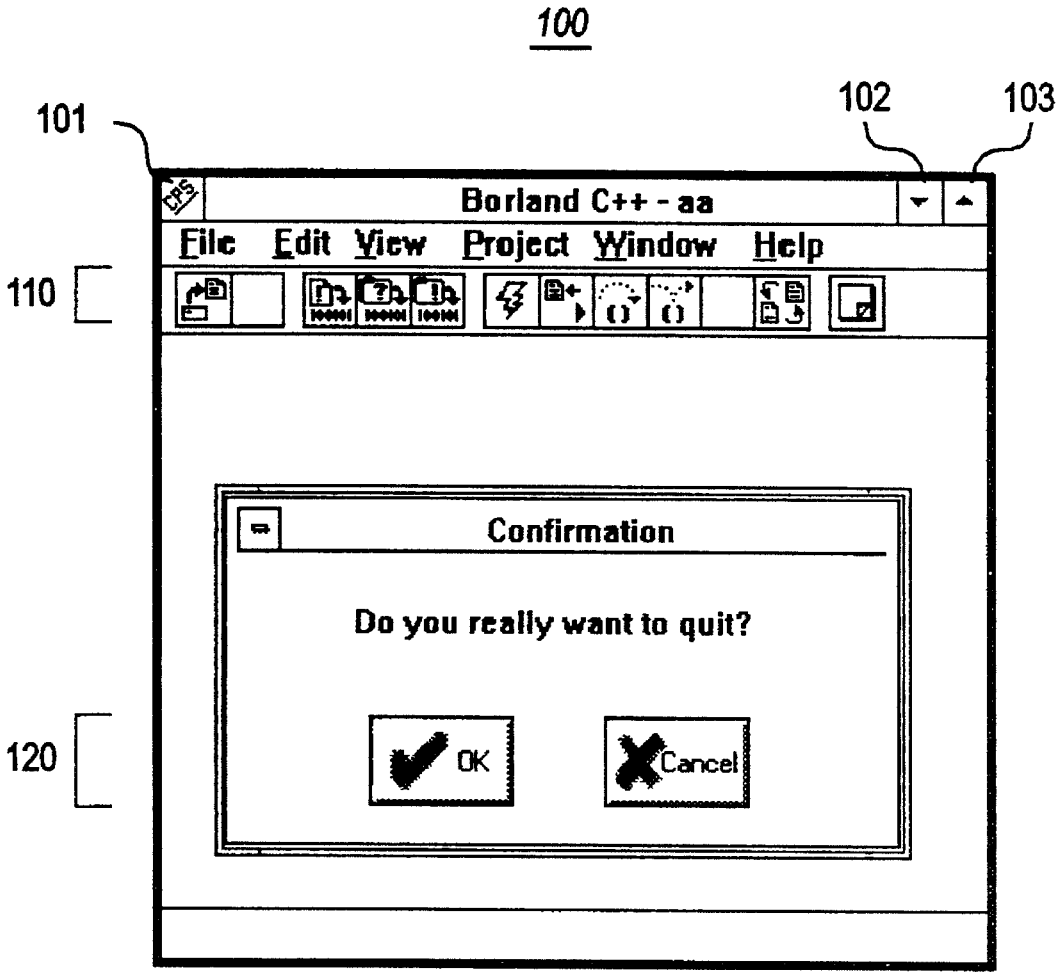
FIG. 1 (PRIOR ART)
FIG. 1 is a bitmap screenshot illustrating use of bitmap images in graphical user interfaces.

The present invention may be embodied on a computer system such as the system 200 of FIG. 2, which includes a central processor 201, a main memory 202, an input/output controller 203, a keyboard 204, a pointing device 205 (e.g., mouse, track ball, pen device, or the like), a display device 206, and a mass storage 207 (e.g., hard disk). Additional input/output devices, such as a printing device 208, may be provided with the system 200 as desired. As shown, the various components of the system 200 communicate through a system bus 210 or similar architecture.

B. System Software

Figure 2A:
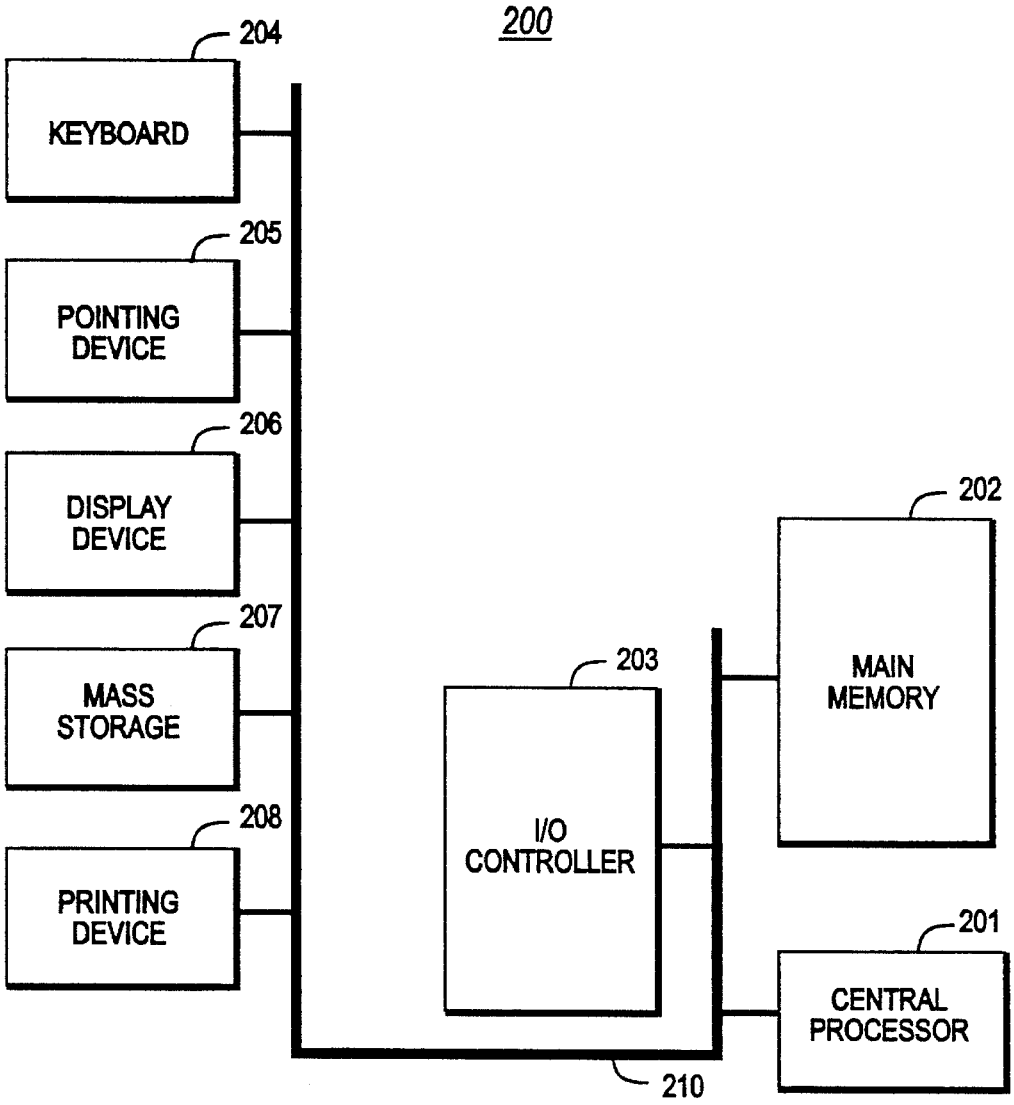
FIG. 2A is a block diagram illustrating a computer system in which the present invention may be embodied.
Figure 2B:
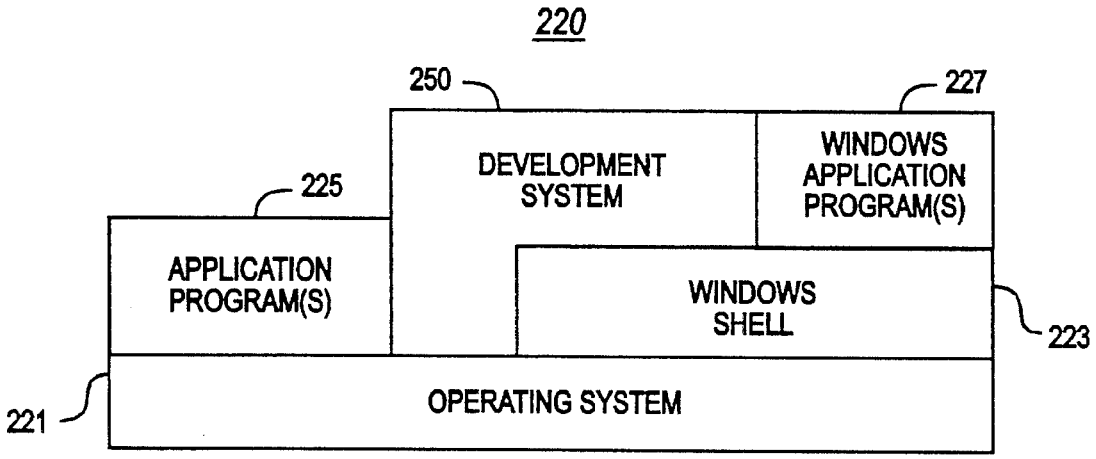
FIG. 2B is a block diagram illustrating a software system for controlling the operation of the computer system of FIG. 2A.

Illustrated in FIG. 2B, a computer software system 220 is provided for programming the operation of the computer system 200. Software system 220, which is stored in system memory 202 and on disk memory 207, includes a kernel or operating system (OS) 221 and a windows shell or interface 223. One or more application programs, such as application programs 225 or windows applications programs 227, may be "loaded" (i.e., transferred from storage 207 into memory 202) for execution by the system 200. OS 221 and shell 223, as well as application software 225, 227 include an interface for receiving user commands and data and displaying results and other useful information. Software system 220 also includes a development system 250 of the present invention for developing system and application programs. As shown, the development system 250 includes components which interface with the system 200 through windows shell 223, as well as components which interface directly through OS 221.

In a preferred embodiment, the system 200 includes an IBM-compatible personal computer, available from a variety of vendors (including IBM of Armonk, N.Y.). Operating system 221 is MS-DOS and shell 223 is Microsoft® Windows, both of which are available from Microsoft Corporation of Redmond, Wash. Alternatively, the system 200 may be implemented in other platforms, including Macintosh, UNIX, and the like. Development system 250 includes Borland® C++ & Application Frameworks™, available from Borland International of Scotts Valley, Calif. Application software 225, 227, on the other hand, can be any one of a variety of application software, including word processing, database, spreadsheet, text editors, and the like.

C. Development System

Figure 2C:
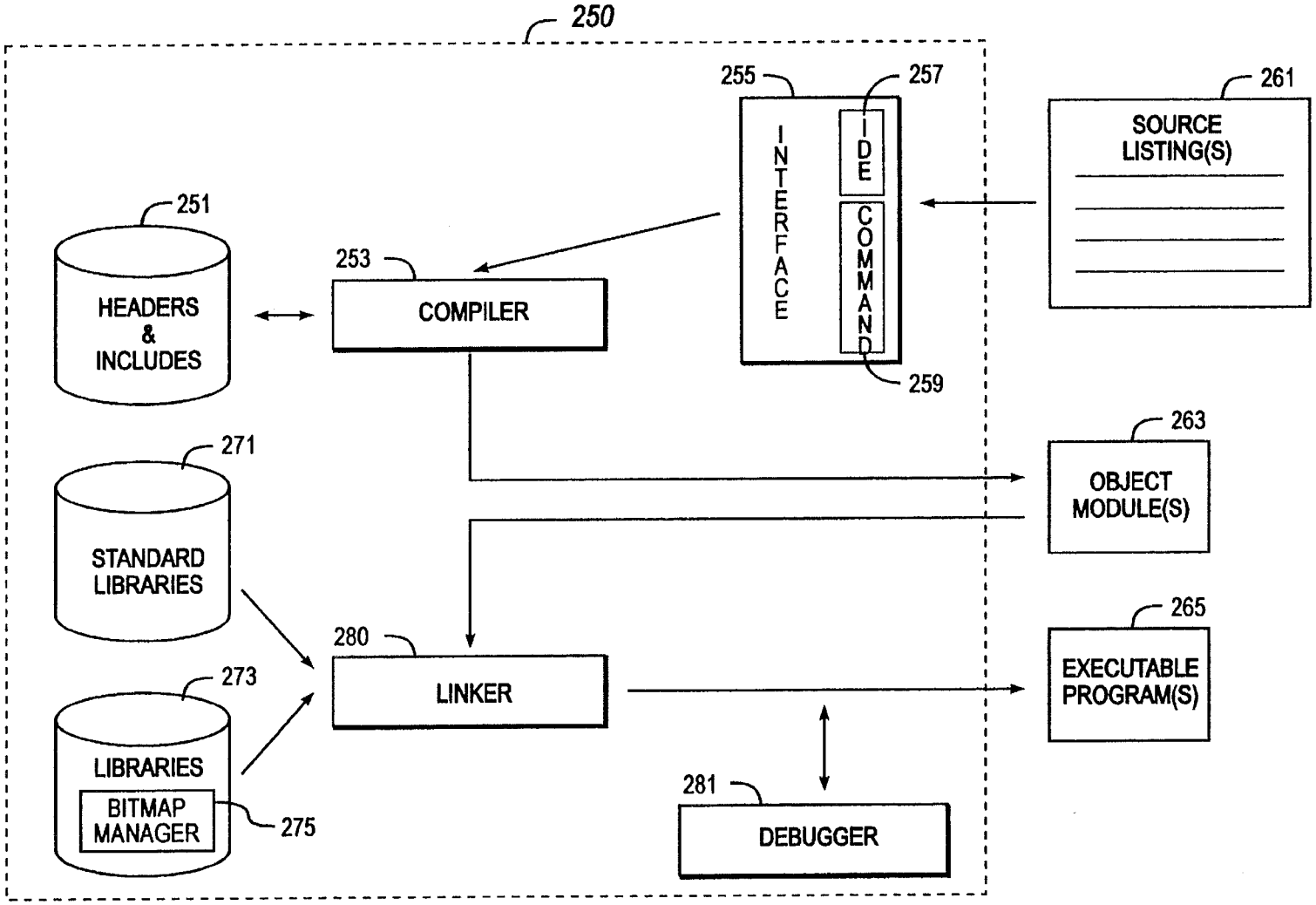
FIG. 2C is a block diagram illustrating a development system of the present invention.

Shown in further detail in FIG. 2C, the development system 250 of the present invention includes an compiler 253, a linker 280, and an interface 255. Through the interface, the developer user supplies source modules 261 to the compiler 253. Interface 255 includes both command-line driven 259 and Integrated Development Environment (IDE) 257 interfaces, the former accepting user commands through command-line parameters, the latter providing menuing equivalents thereof. From the source code 261 and headers/includes files 251, the compiler 253 "compiles" or generates object module(s) 263. In turn, linker 280 "links" or combines the object modules 263 with libraries 271, 273 to generate program(s) 265, which may be executed by a target processor (e.g., processor 201 of FIG. 2A). A debugging module 281 may be added, as desired, for tracking and eliminating errors in the programs 265.

The standard libraries 271 include previously-compiled standard routines, such as graphics, I/O routines, startup code, and the like. Libraries 273 includes additional routines (i.e., in addition to "standard library" routines). In particular, libraries 273 includes a Bitmap Manager 275 of the present invention which includes library routines and methods for processing multi-image bitmaps. Thus, Bitmap Manager methods 275, which are stored in a library (or, alternatively, as a standalone object module), are "linked" into a target program for providing runtime support for processing multi-image bitmaps.

Figure 2D:
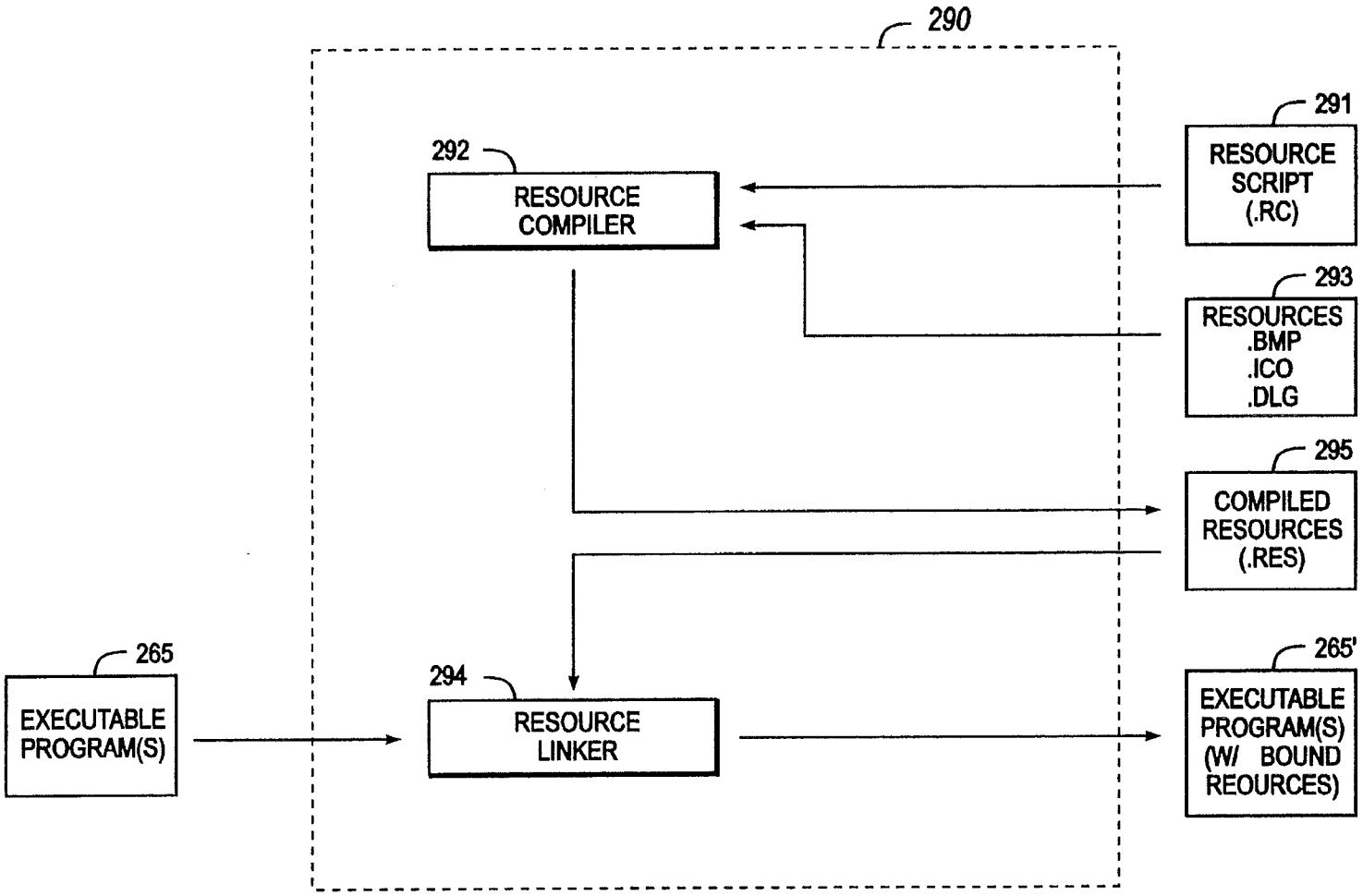
FIG. 2D is a block diagram illustrating a Resource Compiler/Linker subsystem which operates in conjunction with the development system of FIG. 2C.

Before describing the specific methodology employed by the Bitmap Manager 275 in detail, it is helpful to briefly describe the manner in which resources, such as bitmaps, are "bound" into target programs. FIG. 2D illustrates the manner in which resources are bound to executable programs generated by the development system 250 which, in an exemplary embodiment, runs in Microsoft® Windows 3.1. Development system 250 operates in conjunction with resource compiler/linker subsystem 290. In particular, the developer user supplies resource compiler 292 with a resource script 291 and resources 293 (which are to be bound); in an exemplary embodiment, resource compiler 292 is Windows Resource Compiler (available from Microsoft). Resources 293 include disk-resident resources to be bound, including bitmaps (.BMP), icons (.ICO), cursors (.CUR), dialog resources (.DLG), font resources (.FNT), and the like. The resource compiler 292 compiles the resources (specified by script 291) into a compiled resources file (.RES) 295. The Resource Linker 294 takes the compiled resources and links them with the executable program(s) 265, which were created by the development system 250; in an exemplary embodiment, Resource Linker 294 is Windows Resource Linker (available from Microsoft). In this manner, the resources are bound to one or more target programs to generate "bound" executable programs 265'.

Multiple-image Bitmap Processing

A. General Operation

It is helpful at the outset to understand the nature of bitmaps. A "bitmap" is a common way to store graphical data. Typically, a bitmap comprises a rectangular array of bits in which one or more bits correspond to pixels of a graphic image. These blocks of pixel data can be output directly to a device, such as a video display. The simplest bitmap form is the one employed for representing black and white ("monochromatic") images. Here, one bit may be employed for storing each pixel's color: zero for black and one for white. For representing color images, a bitmap requires more than one bit for each pixel. A 16-color bitmap image, such as are commonly employed for VGA displays, would require 4 bits to encode the color of each pixel. A bitmap for a 256-color image requires 8 bits per pixel.

A bitmap is commonly stored in a "bitmap file." Over the years, several bitmap file formats have become popular for the interchange of graphic images on personal computers. Examples include PCX (PC Paintbrush), GIF (Graphics Interchange Format), TIFF (Tagged Image File Format), and BMP (Windows Bitmap). In general, however, a bitmap file consists of discreet blocks of data. In Windows, for instance, the .BMP file may include an information header, a color table, and the bitmap data itself. The bitmap information header stores information about the bitmap, such as the width and height of the image in pixels, and the number of bits that correspond to each pixel. The color table is a collection of RGB (Red-Green-Blue) values; this provides an alternative way of specifying the bitmap colors using RGB color values. The bitmap data is the actual array or block of pixel data defining the image. The bitmap data begins with a particular row of pixels (either the top or bottom, depending on format) and then defines subsequent rows of pixels or "scan lines" in the bitmap. When the term bitmap is used by itself, it typically is referring to this bitmap data; in Windows, this is the bitmap object referenced by a bitmap handle.

Various file formats for storing bitmaps and techniques for displaying bitmaps on display devices are well documented in the trade, technical, and patent literature. See e.g., Petzold, C., What's New in Bitmap Formats, PC Magazine, Sep. 11, 1990; Petzold, C., Bitmap Creation Under Windows, PC Magazine, Jun. 11, 1991; and Petzold, C., The Windows 3.0 Device-Independent Bitmap, PC Magazine, Jun. 25, 1991. The disclosures of each of the foregoing are hereby incorporated by reference.

Figure 3A:
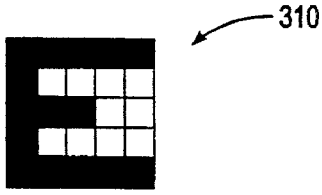
FIGS. 3A–I are diagrams of bitmaps which illustrate a method of the present invention for storing multiple images within a single bitmap.
Figure 3B:
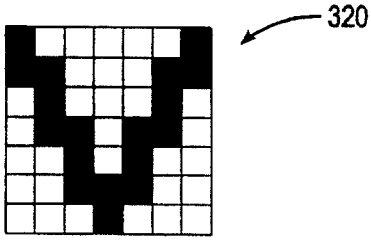

As previously described (in the Background section), bitmap images are conventionally stored one per file. The two bitmap images 310, 320 of FIGS. 3A–B, for instance, would traditionally be stored as two separate files (e.g., file1.bmp and file2.bmp) on a storage device.

Figure 3C:
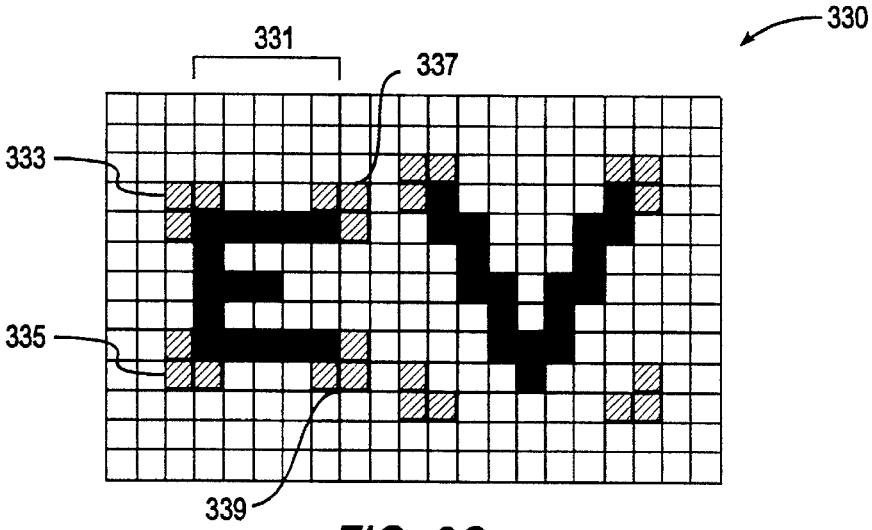

According to the present invention, multiple bitmap images are encoded into a single bitmap resource. As shown by FIG. 3C, for instance, the two bitmaps 310, 320 can be encoded as a single "master" bitmap 330. Within the master bitmap, each image (i.e., a rectangular collection of pixels comprising an image) is bound by "corner brackets." As shown in FIG. 3C, for instance, image 331 is bound by corner brackets 333,335, 337, 339. Each corner bracket in turn comprises a group of pixels which may be identified separately. In an exemplary embodiment, corner bracket pixels assume a value (i.e., color) which differs from that of the master bitmap's background. Thus, for the master bitmap 330, which includes a white background, corner bracket pixels may be gray, for example. The bracket pixels are distinguished because their color is different than the background color (white, in this case).

Figure 3D:
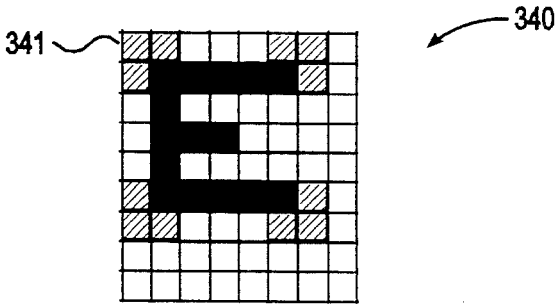

For convenience, the background pixel color may be defined to be that of a known pixel, such as the pixel located at the far upper left of the master bitmap. Whatever pixel is chosen as a reference, that pixel should preferably not be used as a corner bracket. This is illustrated by bitmap 340 of FIG. 3D. If pixel 341 were chosen as the reference pixel for that bitmap, the corner bracket pixel would not be distinguishable from the "background" (when defined as the value of the far upper left pixel). Thus, a reference pixel should typically be selected to yield a value which is reflective of a background for the master bitmap.

According to the present invention, each image within a given master bitmap should be able to be identified and processed as a separate image. Specifically, management of various images within a master bitmap requires facilities for determining the size, position, and identity of each image. Size—the width and height of each image—is easily computed from the distance between the brackets which surround an image. The position (of an image relative to the master bitmap) may be computed relative to the position of its surrounding brackets.

Figure 3E:
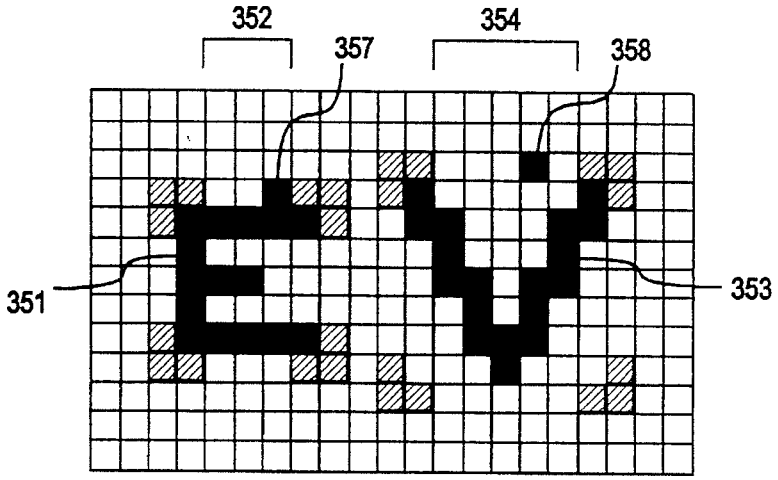
Figure 3F:
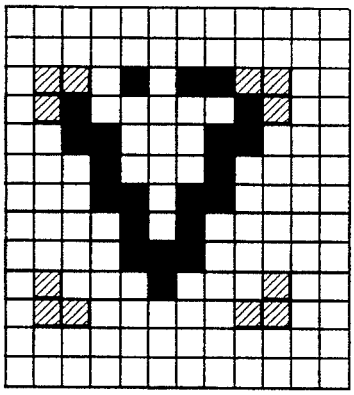

For identity, each image is provided with a unique ID or identifier, such as a number, embedded within the master bitmap itself. As shown in FIG. 3E, each image may be uniquely identified by interpreting (e.g., as binary digits) neighboring pixels, such as the pixels located in the "gutter" between the upper brackets. There, the "E" image 351 is associated with an ID of 1 (encoded in pixels 352), and the "V" image 353 is associated with an ID of 2 (encoded in pixels 354). The binary digits can be read from right to left, starting at the left edge of the upper right bracket, as the sum of powers of two: 1, 2, 4, 8, 16, as so forth. The single pixel 357 above the "E" represents the single binary digit with the decimal value 1. The single pixel 358 above the "V" has the value of 2 because it is in the binary 2's place. FIG. 3F illustrates the representation an ID of 11 (8+2+1). Each image is referenced via its ID. Since the identity of an image is independent of an image's position (recall, the ID pixels move with the image and its corner brackets), the software developer need not be concerned with knowledge about the absolute position of the image within the master bitmap.

B. Bitmaps with "Masks"

Quite often, a user interface must render an image which is not rectangular. This is done by specifying a "mask" to be associated with an image. The drawing surface (usually a window) onto which the non-rectangular image is to be rendered is first prepared by painting the mask on the surface using an "AND" (bitwise) raster operation to blacken the area to be affected. Then the image is painted onto the surface using an "OR" (bitwise) raster operation to fill in the blackened area. Where there is a black pixel in the mask, the corresponding pixel in the image is rendered on the surface, and where there is a white pixel in the mask, the corresponding pixel in the image is not rendered on the surface (the surface is left untouched). A black pixel is one where all the bits in the pixel are 0; a white pixel is one where all the bits in the pixel are 1.

Figure 3G:
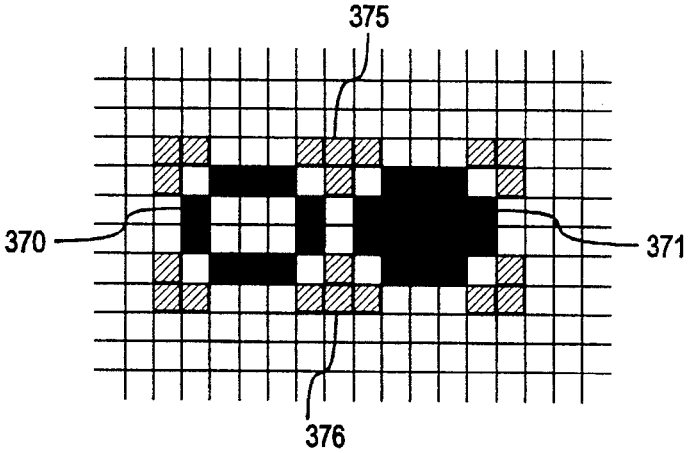

The mask for a particular image may be easily associated with its image using the encoding methodology of the present invention. Consider the bitmap fragment shown in FIG. 3G. There, the bitmap includes on its left an oval 370 with a black border and a white interior. A mask 371 for the oval image appears on the right; it has the same dimensions as the image. "Tee brackets" 375, 376 are employed between the two to indicate that a mask exists for the image. When the image is rendered, the four pixels at the corners of the oval are not rendered; whatever is behind these pixels (on the drawing surface) when the image was rendered will remain the same.

C. Very Small Bitmap Images

Figure 3H:
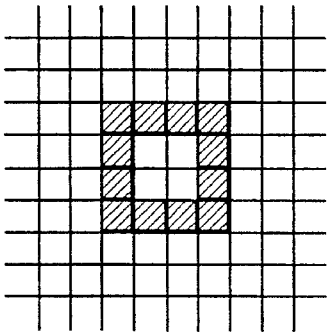
Figure 3I:
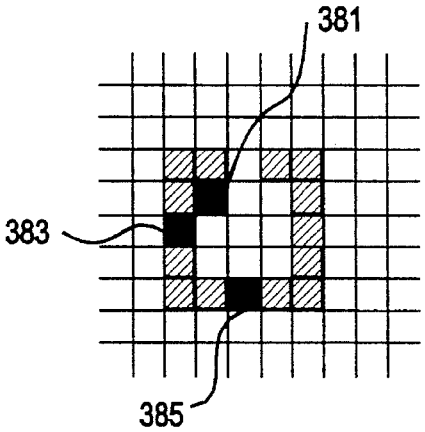

An apparent limitation exists in the foregoing technique, in that there seems to be a minimum image size of 2 by 2 pixels required by the size of the corner brackets. This is illustrated in FIG. 3H. The solution, according to the present invention, is to use the gutter between brackets in the same way that was done with the ID number for a bitmap. Consider a single black pixel as an image, such as pixel 381 in FIG. 3I. There, a pixel in the left and bottom gutters (i.e., pixels 383,385) respectively bound the actual height and width of the image, allowing a small image to be bound by brackets separated at a greater distance. The value (color) of these delimiting pixels should preferably be different from the color of the bracket pixel (so as not to be confused with a corner). Either delimiting pixel may be specified without the other present. This technique can also be applied when the size of the top gutter is too small to encode a large binary ID. By increasing the horizontal distance between the brackets and placing a horizontal size delimiting pixel in bottom gutter, one gains more pixels between the upper left and upper right brackets to encode the larger ID.

D. Advantages Over Fixed-size Encoding

Figure 3J:
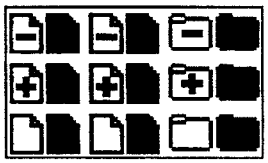
FIG. 3J is a bitmap screenshot illustrating simplistic, conventional storage of multiple images in a single bitmap.

One may place multiple bitmap images in a single bitmap in a conventional manner, as shown in FIG. 3J. That approach, however, requires the programmer to "hard code" the size and position of each image into his program. Also, he or she must do the same for any masks associated with the images.

The preferred encoding methodology of the present invention, in contrast, provides one with the advantage of being able to encode the size, position, mask, and ID into the actual bitmap resource itself; all that is needed by a programmer to reference the image is the ID. One may change the images (resize, add/remove masks, and the like) in the resources without having to alter the program which uses them. This becomes more significant when software must be internationalized where images can change drastically.

The preferred encoding methodology of the present invention also offers advantages of space savings. Each bitmap in the resource section of an executable file can be seen as costing a certain amount of disk space. This space can be broken down into two categories: fixed space and adjustable space. Regardless of the dimensions of a particular bitmap, it takes up a fixed amount of space in a resource in the form of table entries and headers. By encoding multiple images into a single bitmap, this fixed cost is assessed only once. The adjustable portion of the space cost is solely determined by the size of the bitmap.

The extra space required by the corner brackets and gutter spaces to encode the image do not necessarily consume more adjustable space. Contrary to intuition, the technique typically takes up less space. This stems from the requirements of most windows systems that the width of a bitmap be rounded up to a 32 pixel boundary. That is to say, if one were to place a three by three pixel image into a bitmap, the windowing system imposes that there be 29 padding pixels in each row, taking up much more space.

These space costs also apply to the memory resources required to load and hold the bitmaps while the application is executing. By encoding multiple images into a single bitmap, the adjustable cost is applied only once to the single bitmap. This is significant when an application has a large number of small images it needs to manage. In Microsoft® Windows 3.1, for instance, consider three 256 color bitmaps encoded as: a 10×10, a 3×3, and a 5×20. As individual bitmap resources, these take up 3,536 bytes in the executable file. When the three are encoded into a single 21 by 22 pixel bitmap, only 1,600 bytes are used—better than a 2:1 improvement.

The preferred encoding methodology of the present invention also offers advantages of time savings. Each time a bitmap resource is loaded the windowing system must allocate system resources (memory among other things) and read the bitmap from the executable file. It is, again, more timely to simply load a single bitmap resource and decode for embedded images than it is to load each individual bitmap.

Multiple-image Bitmap Decoding

A. Overview

According to the present invention, the Bitmap Manager 275 (of FIG. 2C) decodes a bitmap image by scanning the master bitmap for the upper left corner of an image and then searching for the other three corners, ID, delimiting pixels, and mask (if any). From this process, each image's ID, position, and dimension (and optional mask) may be readily determined. One or more of these images can then be selected from the master bitmap and rendered on a target drawing surface.

B. Data Structures

The following description will focus on exemplary data structures and methods for decoding a master bitmap, implemented in the Bitmap Manager with the C++ programming language. The C++ programming language is well documented in the trade, technical, and patent literature. See, for example, Ellis M. and Stroustrup B., The Annotated C++ Reference Manual, Addison-Wesley, 1990; the disclosure of which is hereby incorporated by reference. Suitable C++ compilers are available from several vendors, including Borland International of Scotts Valley, Calif., Microsoft Corp. of Redmond, Wash., and Symantec Corp. of Cupertino, Calif.. Those skilled in the art, enabled by the teachings of the present invention, will appreciate that the methods of the present invention may be constructed in other development environments as well. Hence, the following is offered for purposes of illustration, not limitation.

An important (but least obvious) data structure required by the decoding method of the present invention is the master bitmap itself. The dimensions of the master bitmap are characterized by two variables:

```
int master_bitmap_width;
int master_bitmap_height;
```

Actual access to the pixels in the master bitmap is acquired via a function which takes the position of the desired pixel and returns a color index of the pixel at that position:

```
typedef unsigned long Pixel;
Pixel get_pixel ( int x, int y );
```

The method assumes that the reference pixel (i.e., the far upper left pixel in a preferred embodiment) is located at coordinates 0,0, whereby the horizontal or "x" component of the position increases as one scans across the right of the bitmap and the vertical or "y" component of the position increases as one scans down the bitmap.

A "background" variable is declared to hold the pixel value associated the reference or background pixel (i.e., the one found in the upper left corner of the master bitmap):

Pixel background;

The output of the decode method is preferably in the form of an array of "Image" records. Each record of the array describes an image, for instance:

```
struct Image
{
    int id;
    int x, y, w, h;
    real_w, real_h;
    int has_mask;
};
```

The id member contains the value of the identifier or "id" associated with the image. In a preferred embodiment, the value of 0 is employed to indicate that no ID is specified for the image. Although the method generally requires that all images have unique IDs, the method allows for multiple images within a master bitmap to have a zero ID. By not specifying an ID for one or more images, one effectively hides the images within the master bitmap for future purposes.

Figure 4:
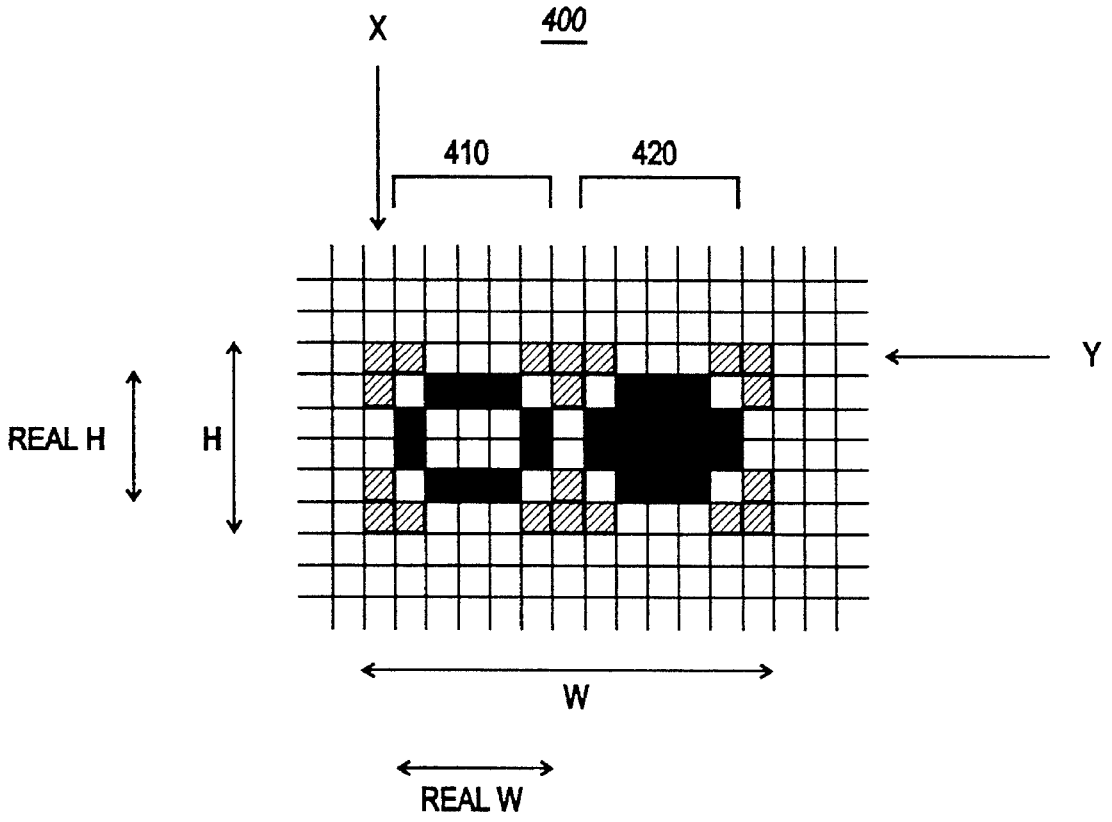
FIG. 4 is a diagram of a bitmap which illustrates exemplary data structures employed by the methods of the present invention for decoding images stored in a single bitmap.

The remaining members of the Image record will be described with reference to FIG. 4. The x and y members identify the position of the upper left pixel of the upper left corner bracket associated with an image (such as image 410 of bitmap 400). The w and h members describe the width and height of the image, including all brackets surrounding the image and optional mask. The has_mask data member, on the other hand, functions as a Boolean (logical true/false) value. If it is set to true (non-zero), a mask is associated with the image, such as mask 420 of FIG. 4. Otherwise, no mask exists. The real_w and real_h members describe the actual dimensions of the image (and mask) without the brackets.

An array of images is defined via an array template capable of growing the number of elements in the array on demand:

AbstractArray<Image>images;

An element of the array can be retrieved/created via an index operator (zero based), for instance:

images [4 ]

The current number of elements in the array (initially set to zero) is obtained via a size member function:

images.size ()

Once a bitmap has been decoded and the array variable "images" has been filled with the size, position, ID and mask information, a developer user can make use of this information when he or she needs to render a bitmap on a drawing surface. By scanning the array for an entry with a specific ID, the developer can readily determine where in the master bitmap a desired image and (optional) mask reside. With this information, the developer can use standard raster operations (e.g., Windows BitBlt operations) to copy the image from the master bitmap to the drawing surface. Those skilled in the art, enabled by the teachings of the present invention, may encapsulate (e.g., in a C++ class) the tasks of searching for the information by ID and rendering the image, thereby allowing for the least work on the developer's side.

C. Preferred Method of Bitmap Decoding

A preferred method for decoding a master bitmap, one employing the aforementioned data structures, will now be described. Generally, this decode method or function operates by scanning a master bitmap (e.g., from left to right, top to bottom) looking for a pixel which is not the background color, and skipping over regions already occupied by existing images; once such a pixel is found, the image is further decoded.

Referring now to FIGS. 5A–B, the operation of the decode function will now be described in detail; commented C/C++ source listings are included for further illustrating steps of the process. At step 501, the method initializes the value of the background pixel to be that of the one in the far upper left hand corner (i.e., reference pixel) of the master bitmap. At step 503, x and y data members are employed for scanning the master bitmap from left to right, top to bottom, starting at the pixel just to the right of the far upper left corner (the background pixel should not be used for other purposes). At step 505, the method checks whether the current position (defined by x and y) is part of an image which has already been decoded. This is done by calling a pixel_inside_image subroutine, which returns 0 (NULL pointer) if no such image exists, otherwise it returns the image overlapping the pixel at (x,y).

At step 507, if there is no overlapping image, and the pixel at the current position is not the same as the background pixel, then the method decodes the image at this current position. The decoding process itself is done by a decode_image routine (described in detail below). Next, at step 509, the method advances the x component of the current position. If there was either an image already at this position, or an image here was just decoded, then the method skips (i.e., jumps past) the image to the right. If there was no image there, then the method simply advances the x component to the right by one pixel.

At step 511, if the current x position is outside the master bitmap, the method advances to the next scan line and resets the x component to be at the far left of the master bitmap. Finally, at step 531, if the y component of the current position is outside the master bitmap, then the method has completely scanned the master bitmap and may now exit the "for" loop (by executing the break statement).

The pixel_inside_image subroutine, which was invoked at step 505 above, will now be described. Illustrated in FIG. 6, this method starts by iterating through all the currently decoded images, at step 601. If the position, defined by the arguments supplied to this function, is within the current image, then the method returns that image, at step 603. If, on the other hand, no image was found which overlaps the given position, this method returns a zero indicating such, at step 605.

As mention at step 507 above, the actual work of decoding an image is performed by the decode_image method or function. Once the upper left corner of a bracket is found, this function takes over (i.e., invoked at step 507) to decode the image as a whole, including locating and identifying the corner brackets, locating an (optional) image mask, and decoding the image ID. This method operates to add a new image entry or record to the images array; it returns a pointer to the image it just added.

Referring now to FIGS. 7A–F, operation of the decode_image method will now be described. At step 701, the method determines the pixel value of the upper left corner of the upper left bracket of this image and stores this to a local variable, p. Next, at step 703, the method performs error checking to make sure that the upper left corner is complete. An assert function is invoked to simply check its only argument to make sure it is not non-zero. If it is, however, then a failure is triggered.

Continuing to step 705, the left edge is "remembered" (value stored) in a variable, left_x. At step 707, the method scans along the top gutter of the image, looking for the left edge of either an upper right corner bracket or the upper tee bracket (which must be the same color as the upper left corner bracket). At step 709, the method makes sure it did not fall off the end of the master bitmap, and that it did indeed find the edge of the upper right corner bracket/tee bracket. Again, at step 711, the method checks to make sure that the upper right corner bracket is complete, and that the other two pixels comprising it are of the same color. Now, at step 713, the method checks whether there is a mask associated with this image. The has_mask variable is initialized to "false"; it will be set to "true" later if a mask is found.

At step 715, the method increments or "bumps" the x position to be either the right edge of the upper right corner bracket, or the middle of a possible tee bracket. Then at step 717, the method checks to see if there is a fourth pixel comprising a tee bracket. Also here, the method checks to make sure it is not trying to look at pixels which are not in the master bitmap. At step 719, the current x position is saved; this happens to be the middle of the upper tee bracket. At step 721, x is pushed past the last farthest right pixel in the upper tee, while the method scans for the leftmost pixel of the upper right bracket. At step 723, the method checks to make sure it did not fall off the end of the master bitmap and that it has, indeed, found the corner bracket. At step 725, the method makes sure that the upper right corner bracket is complete. Then, the x position is pushed past the end of the upper right corner, at step 727. The widths of the image and the mask are checked at step 729 to make sure they are the same. At step 731, the has_mask flag is toggled to "true," to indicate that a mask exists.

Proceeding to step 733, the method computes and remembers the width of the image and mask, including the brackets. And at step 735, the method remembers the position of the top edge of the upper corner brackets. Then at step 737, the method scans down to find the lower right bracket, making sure it does not fall off the end of the master bitmap. The method checks, at step 739, that it did indeed find the lower right corner bracket; it also makes sure the bracket is complete at this step. At step 741, the y position is adjusted so that it is at the bottom edge of the lower brackets. Then, at step 743, the height of the image, including the upper and lower bracket gutters, is computed. On to step 745, the method confirms that the lower left bracket exists and is complete. If there is a mask associated with this image (i.e., has_mask has been set), the method checks at step 747 to make sure that there is a middle tee bracket between the image and the mask.

Now, the method may scan for a binary encoded ID in the upper left gutter, at step 749. A local variable, id_x, is declared at step 751; it will start at the far right edge of the gutter (to the left of any existing tee bracket), where the first binary digit will exist. Another local variable, power_two, is initialized step 753; it will start at one and be doubled through each digit. At step 755, the method scans id_x to the left, going no further that the upper left corner bracket. Also, the ID is limited to a reasonable value (e.g., 512). If the current digit pixel is not the background pixel, at step 757, then it represents a 1 binary digit; the id is adjusted as needed.

At step 759, the method checks to see if there are any dimension limiting pixels in both the left and bottom gutter. First, the left gutter is scanned. Specifically, at step 761, the method scans down the left gutter, searching for a height delimiting pixel. Then, the bottom gutter is scanned for a width delimiting pixel, at step 763. Here, the method only scans as far as last_x, which is the left edge of the far right bracket or tee bracket. At step 765, the method scans to the right, starting from the right edge of the left corner bracket. Finally, the new image data is added to the array at step 767, with the method filling in the new entry. The method concludes by returning this information to its caller, the decode method.

D. Example: Use in Microsoft Windows 3.1

The following example will focus on rendering an image in Microsoft Windows 3.1—a well known environment. Those skilled in the art will appreciate application of the example to other GUI environments. Therefore, the following is offered for purposes of illustration, not limitation.

The methods of the present invention for rendering a single image (e.g., image 353 of FIG. 3E) from a master bitmap may be employed as follows:

```
// Example of use in Windows 3.1
// Task: Render second image 353 of FIG. 3E
// Declare global data
//  (1) Windows data structures
HDC hdcMem; // Handle to display context, Win data struct
//  (2) Data structures used by decode routine
Pixel background;      // (defined above)
int master_bitmap_width, master_bitmap_height;
AbstractArray < Image > images; // array container
// Function which uses Windows GetPixel API call
Pixel get_pixel ( int x, int y)
{
    return GetPixel( hdcMem, x, y ); // Win API call
}
// DrawBitmap is a function which draws image 353 (ID of 2)
// into a window (passed as the first argument) at a
// specified position (passed in as the second and third
// arguments). In this example, the Master bitmap has
// been identified in the resource script as "BMP_1"
void DrawBitmap ( HWND window, int x_pos, int y_pos )
{
    // First, load the master bitmap, using Win API call
    HBITMAP bitmap_handle = LoadBitmap( hInstance,
    "BMP_1" );
    // Create a memory dc to hold the Master bitmap, and
    // select it into the hdc, using Win API calls.
    hdcMem = CreateCompatibleDC( NULL );
    SelectObject( hdcMem, bitmap_handle );
    // Next, get its dimensions, using Win API call
    DWORD dimensions =
    GetBitmapDimension(bitmap_handle );
    // Set height and width for master
    master_bitmap_width = LOWORD( dimensions );
    master_bitmap_height = HIWORD( dimensions );
    // Now, call the decode routine
    decode ( );
    // Step through image array, search for this image (ID of 2)
    for ( int i = 0 ; i < images.size( ) ; i++ )
      if (images[i].id == 2)
        // found ID of 2 here
        break;
    // Get the DC of the window, using Win API call
    HDC hdcDest = GetDC( window );
    // Use Windows GDI call, BitBlt, to do actual drawing.
    // Draws bitmap at location passed in as arguments
    BitBlt( hdcDest, x_pos, y_pos, images[i].real_w,
            images[i].real h, hdc,
            images[i].x + 1, // past the bracket by 1 pixel
            images[i].y + 1,
            SRCCOPY );
    // Free up the destination DC, using a Win API call
    ReleaseDC( window, hdcDest );
    // Free up memory DC, using Vin API call
    DeleteDC( hdcMem );
}
```

As shown, some initial data structures and a get_pixel function are first declared. The function DrawBitmap performs the actual rendering of image 353. In operation, the function first loads a master bitmap. In Windows, this may be accomplished by a simple Windows API call to LoadBitmap, with the name/ID of the master bitmap (as defined in the resource script) being passed in. The call returns a Windows bitmap handle data type (here, locally defined as bitmap_handle). A Windows memory display context for holding the master bitmap is instantiated; the master bitmap may be selected into this display context (by calling Windows SelectObject). Using the bitmap handle, the dimensions (stored as dimensions) of the master bitmap (by calling Windows GetBitmapDimension) are obtained. From dimensions, the width and height may be extracted.

Next, the decode function is invoked; it fills in the image array for the given master bitmap. Now, the particular image of interest (i.e., image 353 of FIG. 3E) may be located by matching its unique ID with those present in the image array. After the image is located, it may be rendered to the drawing surface. For Windows, the bitmap may be rendered by a call to Windows BitBlt function. Finally, the DrawBitmap function concludes by performing any necessary cleanup (e.g., freeing up the memory and destination display contexts).

Figure 8A:
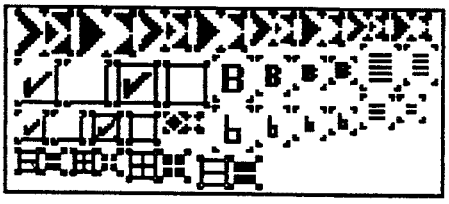
FIGS. 8A–C are bitmaps illustrating exemplary master bitmaps of the present invention.
Figure 8B:
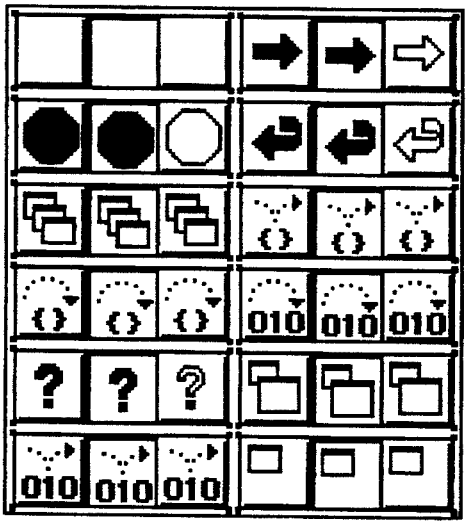
Figure 8C:
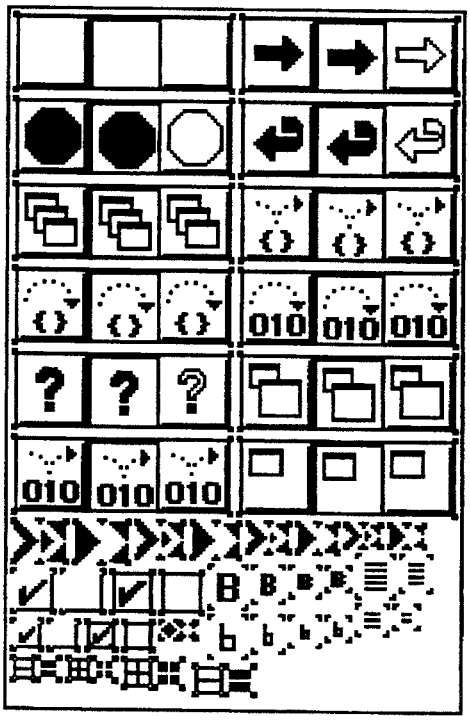

FIGS. 8A–C illustrates multi-image bitmaps, constructed in accordance with the present invention, which are useful in a GUI environment, such as Microsoft Windows. FIG. 8A illustrates a single master bitmap storing multiple resource images, such as glyphs used for on-screen checkboxes. As shown, the individual images may be of varying size and need not be located at any particular location in the bitmap. FIG. 8B, on the other hand, illustrates that an individual "image" (region enclosed by corner brackets) within a bitmap may include subimages. Suppose, for instance, that a screen button has three states: normal, depressed, and disabled. Images for all three states may be stored as a single image, as shown in FIG. 8B. Finally, FIG. 8C indicates that the storage technique employed in FIG. 8A and FIG. 8B may co-exist in a single bitmap.

While the invention is described in some detail with specific reference to a single preferred embodiment and certain alternatives, there is no intent to limit the invention to that particular embodiment or those specific alternatives. Thus, the true scope of the present invention is not limited to any one of the foregoing exemplary embodiments but is instead defined by the following claims.

What is claimed is:

1. In a computer system, a method for encoding multiple images into a single bitmap, the method comprising:

(a) storing a plurality of images in the bitmap; and (b) for each particular image of said plurality of images stored in the bitmap:

(1) storing in the bitmap at least one delimiter for marking boundaries of the particular image, so that the boundaries of the particular image can be determined, and (2) storing in the bitmap at a location in the bitmap apart from where the particular image itself is stored an identifier for the particular image, so that the image can be distinguished from other images of said plurality of images stored in the bitmap.

2. The method of claim 1, wherein each of said plurality of images comprises a rectangular array of pixel values and wherein said at least one delimiter includes four delimiters, each one positioned at a corner of said rectangular array of pixel values.

3. The method of claim 1, wherein said identifier includes a binary digit encoded in the bitmap proximate said at least one image.

4. The method of claim 3, wherein said bitmap includes a gutter region lying between pairs of said at least one delimiter, and wherein said binary digit is encoded in a gutter region which is proximate said at least one image.

5. The method of claim 1, further comprising:

(c) retrieving a desired one of the images from the bitmap by:

(1) specifying the identifier for the desired image, (2) scanning the bitmap for locating an image having an identifier matching said specified identifier, and (3) if an image is located having an identifier matching said specified identifier, retrieving an array of pixels within said at least one delimiter for the desired image.

6. In a computer system, a method for encoding multiple images into a single bitmap, the method comprising:

(a) storing at least one image in the bitmap; and (b) for each said at least one image stored in the bitmap:

(1) storing in the bitmap at least one delimiter for marking boundaries of the image, and (2) storing in the bitmap an identifier for the image, so that the image may be distinguished from other images stored in the bitmap;

wherein said bitmap comprises an array of pixel values representing images and wherein step (b)(1) includes:

selecting a single pixel of the bitmap to serve as a reference, said single pixel having a color value; and storing in said bitmap at least one bracket for delimiting boundaries of the image, said at least one bracket having a color value different from that of said single pixel.

7. The method of claim 6, wherein said array of pixels comprises a two-dimensional array of pixels and wherein said single pixel is a pixel selected from one corner of said two-dimensional array of pixels.

8. The method of claim 7, where in said single pixel is an uppermost, leftmost pixel selected from said two-dimensional array of pixels.

9. The method of claim 6, wherein said single pixel is one selected to represent a background color for the bitmap.

10. The method of claim 9, wherein said background color is white and said at least one delimiter has a color of gray.

11. In a computer system, a method for encoding multiple images into a single bitmap, the method comprising:

(a) storing at least one image in the bitmap: and (b) for each said at least one image stored in the bitmap:

(1) storing in the bitmap at least one delimiter for marking boundaries of the image, and (2) storing in the bitmap an identifier for the image, so that the image may be distinguished from other images stored in the bitmap:

(c) storing in the bitmap a bitmap mask for at least one of said images, said mask for rendering an image which is not rectangular; and (d) storing in the bitmap at least one mask delimiter for said mask, thereby associating the mask with a particular image.

12. The method of claim 11, wherein said at least one mask delimiter includes pixels in the form of a "T" bracket interposed between an image and its mask.

13. In a computer system, an improved method for storing bitmapped images, the improvement comprising:

(a) storing a plurality of images of various sizes in a single bitmap; and (b) for each particular image of said images, (i) embedding within the bitmap itself information indicating dimensions of the particular image, so that the boundaries of each image can be determined; and (ii) embedding within the bitmap itself at a location in the bitmap other than where the particular image itself is stored a unique identifier for the particular image, so that the particular image can be distinguished from other images of said plurality of images stored in the bitmap.

14. The method of claim 13, wherein said unique identifier for an image is independent of an image's position within said bitmap.

15. The method of claim 13, wherein step (b) includes:

disabling an identifier of an image by storing a pre-selected value as the identifier, whereby images having identifiers set to said pre-selected value are temporarily hidden within said bitmap.

16. The method of claim 15, wherein said pre-selected value equals zero.

17. The method of claim 13, wherein step (a) includes:

storing images of various sizes at non-fixed locations within the single bitmap.

18. The method of claim 13, wherein step (b) includes:

specifying a size for an image by storing within the bitmap a plurality of corner brackets which surround the image.

19. The method of claim 18, wherein a width for an image is computed by measuring horizontal distance between opposing corner brackets.

20. The method of claim 18, wherein a height for an image is computed by measuring vertical distance between opposing corner brackets.

21. The method of claim 18, wherein said corner brackets comprise pixels having a color value which allows the corner brackets to be distinguished from other pixels of the bitmap.

22. The method of claim 18, wherein said unique identifier for an image includes a binary digit embedded at a location between opposing corner brackets.

23. The method of claim 13, wherein said unique identifier for an image includes a binary digit embedded in the bitmap proximate the image.

24. The method of claim 13, further comprising:

(c) retrieving a stored image by:

(1) specifying the identifier for the stored image, (2) scanning the bitmap for locating a stored image having an identifier matching said specified identifier, (3) if an image is located, determining the size of the image from said embedded size, and (4) retrieving from the bitmap an image portion corresponding to said determined size at said located image.

25. In a computer system, an improved method for storing bitmapped images, the improvement comprising:

(a) storing a plurality of images in a single bitmap; and (b) for each of said images, embedding within the bitmap itself information indicating dimensions and a unique identifier for the image;

(c) storing in the bitmap a mask for at least one of the images, for rendering an image which is not rectangular;

(d) surrounding said mask and its corresponding image with corner brackets, for indicating size; and (e) separating the image from its mask by interposing "T" brackets.

26. An image processing system comprising:

(a) means for receiving information specifying a plurality of images of various sizes;

(b) storage means for storing said plurality of images in a single bitmap; and (c) storage means for storing with each particular image of said plurality of images stored in the bitmap at least one delimiter for marking boundaries of the image, and an identifier for the image, said particular image itself being stored at bits of the bitmap other than bits employed from storing said at least one delimiter and storing said identifier; so that the image may be distinguished from other images stored in the bitmap.

27. The system of claim 26, wherein said at least one delimiter includes brackets defining an extent of the image.

28. The system of claim 26, wherein said identifier includes a code embedded in the bitmap which uniquely identifies the image.

29. The system of claim 26, further comprising:

means for decoding a desired image stored in the bitmap based on a specified identifier.

30. The system of claim 29, wherein said means for decoding includes:

means for scanning the bitmap for locating a stored image having an identifier matching said specified identifier.

* * * * *